US009464513B2

(12) United States Patent
McConaghy et al.

(10) Patent No.: US 9,464,513 B2
(45) Date of Patent: Oct. 11, 2016

(54) SYSTEM FOR PROVIDING UNIFORM HEATING TO SUBTERRANEAN FORMATION FOR RECOVERY OF MINERAL DEPOSITS

(75) Inventors: James R. McConaghy, Salida, CO (US); Leonard H. Switzer, III, Rifle, CO (US); Alan K. Burnham, Livermore, CA (US); Roger L. Day, Rifle, CO (US)

(73) Assignee: American Shale Oil, LLC, Newark, NJ (US)

( * ) Notice: Subject to any disclaimer, the term of this patent is extended or adjusted under 35 U.S.C. 154(b) by 781 days.

(21) Appl. No.: 13/643,984

(22) PCT Filed: Apr. 27, 2011

(86) PCT No.: PCT/US2011/034213

§ 371 (c)(1),
(2), (4) Date: Mar. 20, 2013

(87) PCT Pub. No.: WO2011/137196

PCT Pub. Date: Nov. 3, 2011

(65) Prior Publication Data

US 2013/0199786 A1 Aug. 8, 2013

Related U.S. Application Data

(60) Provisional application No. 61/328,519, filed on Apr. 27, 2010.

(51) Int. Cl.
*E21B 43/24* (2006.01)
*E21B 36/00* (2006.01)
(Continued)

(52) U.S. Cl.
CPC ..... *E21B 43/24* (2013.01); *E21B 36/00* (2013.01); *E21B 36/04* (2013.01); *E21B 43/121* (2013.01); *E21B 43/2401* (2013.01)

(58) Field of Classification Search
CPC .... E21B 43/24; E21B 43/2401; E21B 36/04; E21B 36/00
See application file for complete search history.

(56) References Cited

U.S. PATENT DOCUMENTS 1,525,656 A * 2/1925 Redfield ..... 392/302
2,801,089 A 7/1957 Scott, Jr.
(Continued)

FOREIGN PATENT DOCUMENTS

CN 101163858 A 4/2008
WO 2006116096 A1 11/2006

OTHER PUBLICATIONS

International Search Report and Written Opinion issued in PCT/US2011/034213, mailed Aug. 1, 2011, 12 pages.

*Primary Examiner* — Jennifer H Gay
*Assistant Examiner* — George Gray
(74) *Attorney, Agent, or Firm* — Perkins Coie LLP

(57) ABSTRACT

A heating system for a subterranean mineral formation according to embodiments of the present invention includes a casing positioned in a bore in the subterranean mineral formation, the casing having an outer surface and an inner surface, a heating element positioned within the casing, a surface connection system having a first end coupled to the heating element within the casing and a second end at a top ground surface above the subterranean mineral formation, a heat transfer fluid contained within the casing, the heat transfer fluid configured to transfer heat between the heating element and the inner surface of the casing, wherein at least a portion of the heat transfer fluid is undergoing phase changes between liquid and gas in order to regulate a temperature of the casing. Fins may be included on the outside of the casing to enhance heat transfer.

5 Claims, 13 Drawing Sheets

(51) Int. Cl.
*E21B 36/04* (2006.01)
*E21B 43/12* (2006.01)

(56) References Cited

U.S. PATENT DOCUMENTS

| | | | | |
|---|---|---|---|---|
| 2,836,248 | A * | 5/1958 | Covington | 166/61 |
| 3,045,099 | A | 7/1962 | Bowman et al. | |
| 3,466,244 | A | 9/1969 | Abel | |
| 4,018,280 | A | 4/1977 | Daviduk | |
| 4,384,613 | A | 5/1983 | Owen | |
| 4,401,163 | A | 8/1983 | Elkins | |
| 4,445,570 | A | 5/1984 | Retallick | |
| 4,687,420 | A * | 8/1987 | Bentley | 417/240 |
| 4,928,765 | A | 5/1990 | Nielson | |
| 5,515,679 | A | 5/1996 | Shulman | |
| 5,816,325 | A | 10/1998 | Hytken | |
| 5,918,672 | A | 7/1999 | McConnell et al. | |
| 6,712,136 | B2 | 3/2004 | de Rouffignac et al. | |
| 6,896,053 | B2 | 5/2005 | Berchenko | |
| 6,991,032 | B2 | 1/2006 | Berchenko | |
| 6,997,518 | B2 | 2/2006 | Vinegar | |
| 7,299,873 | B2 | 11/2007 | Hartman et al. | |
| 7,743,826 | B2 | 6/2010 | Harris | |
| 2002/0074122 | A1 | 6/2002 | Kelley | |
| 2003/0111223 | A1* | 6/2003 | Rouffignac et al. | 166/256 |
| 2007/0045266 | A1 | 3/2007 | Sandberg et al. | |
| 2007/0193743 | A1 | 8/2007 | Harris et al. | |
| 2009/0084547 | A1 | 4/2009 | Farmayan et al. | |
| 2009/0095478 | A1 | 4/2009 | Karanikas et al. | |
| 2010/0258265 | A1* | 10/2010 | Karanikas et al. | 165/45 |

* cited by examiner

SYSTEM FOR PROVIDING UNIFORM HEATING TO SUBTERRANEAN FORMATION FOR RECOVERY OF MINERAL DEPOSITS

CROSS-REFERENCE TO RELATED APPLICATION

This application claims the benefit of U.S. Provisional Patent Application Ser. No. 61/328,519, filed on Apr. 27, 2010, which is incorporated herein by reference in its entirety for all purposes.

TECHNICAL FIELD

Embodiments of the present invention relate to systems and methods for uniform heating of subterranean formations for recovery of mineral deposits.

BACKGROUND

The in-situ extraction of minerals often involves the application of heat to enhance viscosity reduction, partial decomposition and upgrading, and solubility. Examples of fossil fuels subject to in-situ extraction are oil sands, oil shale, and coal. In some cases, the uniformity of heat application is desirable, because too little heat may reduce the extent of the desired changes facilitating extraction, and too much heat may degrade the desired products into less valuable products. For example, an effective heat transfer to surrounding mineral deposits promotes enough in-situ cracking and hydrogenation for oil sands and oil shale recovery to provide a premium quality synthetic crude oil without cracking a substantial portion to less valuable gas and the formation of coke.

Effective extraction of valuable products from of these types of mineral formations involves distribution of heat throughout a large volume of ore. Consequently, applying the heat at the highest possible temperature is desirable. However, heterogeneities in geology may affect the rate at which the formation may accept and dissipate heat. If the power of the heater is constant along its length, that may cause underheating or overheating in parts of the formation that dissipate the heat more quickly or more slowly than average. That underheating or overheating might cause local underconversion or product degradation.

Some existing systems intended to prevent overheating involve temperature-limited electric heaters that are designed for in-situ mineral extraction. The temperature limit enables the maximum allowable power to be applied to the entire formation, even when the heat acceptance varies with location in the formation. The resistance of the heating elements or dielectrics in the heaters is often temperature dependent, such that the power lowers as a target temperature is reached to prevent overheating. Such methods may, for example, use the Curie point of the conductor to change its resistance at a desired maximum temperature.

SUMMARY

A heating system for a subterranean mineral formation according to embodiments of the present invention includes a casing positioned in a bore in the subterranean mineral formation, the casing having an outer surface and an inner surface, a heating element positioned within the casing, a surface connection system having a first end coupled to the heating element within the casing and a second end at a top ground surface above the subterranean mineral formation, and a heat transfer fluid contained within the casing, the heat transfer fluid configured to transfer heat between the heating element and the inner surface of the casing, wherein at least a portion of the heat transfer fluid is undergoing phase changes between liquid and gas in order to regulate a temperature of the casing.

A method for heating a subterranean mineral formation according to embodiments of the present invention includes placing a casing within in a bore in the subterranean mineral formation, the casing having an outer surface and an inner surface, a heating element positioned within the casing, and a heat transfer fluid contained within the casing. The method further includes supplying power to the heating element, and causing at least a portion of the heat transfer fluid to undergo phase changes between liquid and gas in order to regulate a temperature of the casing, the heat transfer fluid transferring heat from the heating element to the casing.

A heating system for a subterranean mineral formation according to another embodiment of the present invention includes a casing positioned in a bore in the subterranean mineral formation, the casing having an outer surface and an inner surface, a heating element positioned within the casing, wherein the casing is at least partially immersed in a boiling fluid in the bore of the subterranean mineral formation, wherein the boiling fluid enhances heat transfer from the outer surface of the casing to the subterranean mineral formation, and a plurality of fins on the outer surface of the casing, the plurality of fins configured to enhance a rate of heat transfer between the casing and the subterranean mineral formation.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
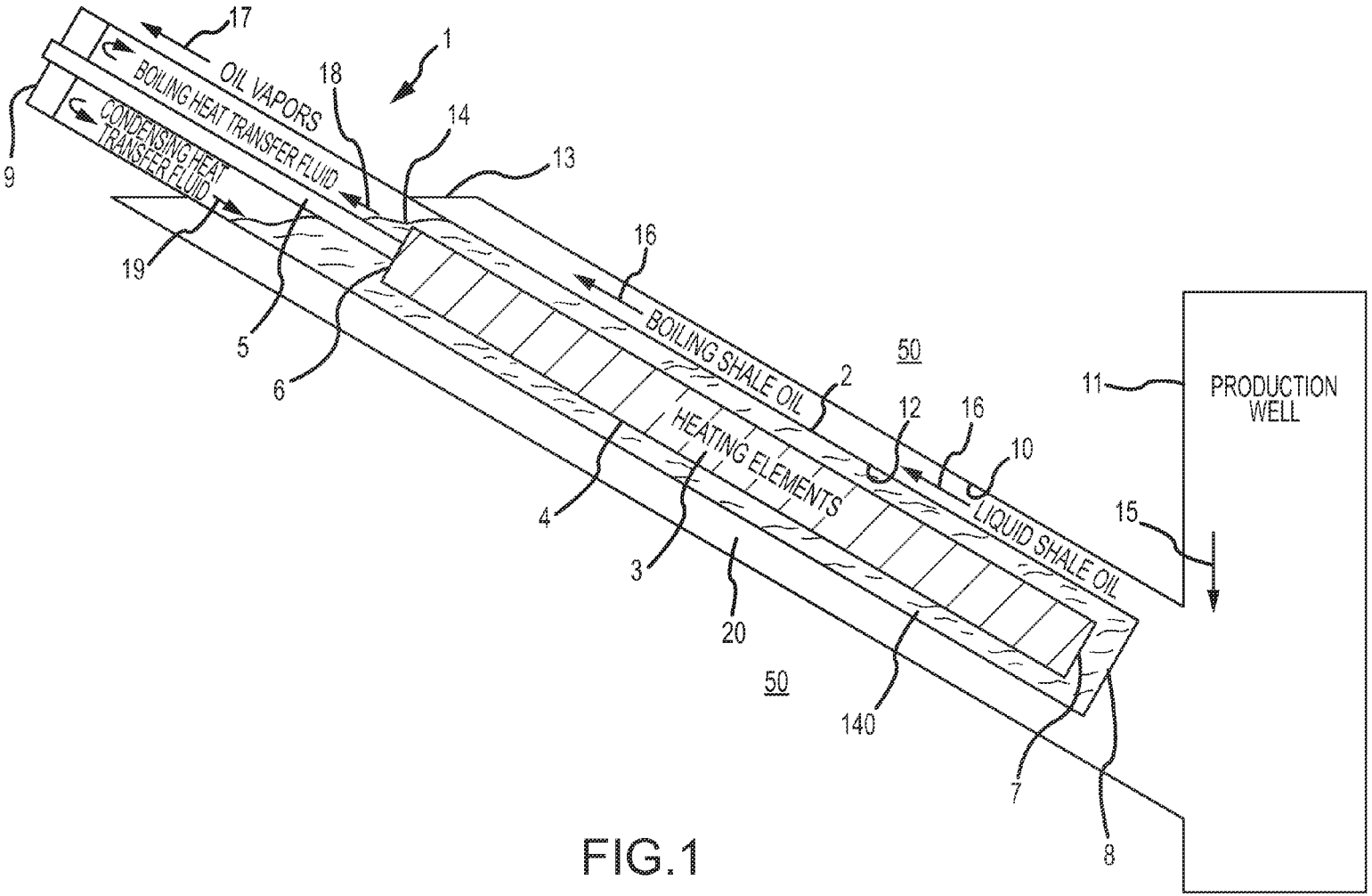
FIG. 1 illustrates a partial side sectional view of a heating system in a subterranean mineral formation, according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1 illustrates a heating system 1 for a subterranean mineral formation 50, according to embodiments of the present invention. The heating system 1 includes a casing 2 positioned in a bore 10 in the subterranean mineral formation 50, and the casing 2 has an outer surface and an inner surface 12. A heating element 3 is positioned within the casing 2. A heat transfer fluid 140 is also contained within the casing 2, with the upper level of the heat transfer fluid 140 being indicated by reference number 14. The heat transfer fluid 140 may be a heat transfer fluid selected from those listed in Table 1, or may be another kind of suitable heat transfer fluid. The heat transfer fluid 140 transfers heat between the heating element 3 and the inner surface 12 of the casing 2.

According to some embodiments of the present invention, the well bore 10 may be drilled at an angle to join a production well 11. Various systems and methods for extracting liquid shale oil and shale oil vapors are described in U.S. Pat. No. 7,921,907, granted on Apr. 12, 2011, which is incorporated by reference herein in its entirety for all purposes. Gravitational forces, for example, the earth's primary downward gravitational force indicated by arrow 15, forces liquid shale oil 20 down the production well 11 and down toward a bottom of the well bore 10 of the heater well. A top level of the liquid shale oil 20 is indicated at reference 13. The casing 2 has a distal end 8 and a proximal end 9, and the heating assembly 1 may be inserted into and/or deployed within the well bore 10 with the distal end 8 closer to the production well 11 than the proximal end 9, according to embodiments of the present invention. The heating assembly 1 elements of FIGS. 1, 2, and 9 may be substantially cylindrical or tubular in order to facilitate their insertion into and deployment in well bores 10, according to embodiments of the present invention. As such, a longitudinal dimension of the heating system 1 is substantially aligned with a longitudinal dimension of the well bore 10, as illustrated in FIG. 1, according to embodiments of the present invention.

The casing 2 is at least partially immersed in a boiling fluid 20 in the bore 10 of the subterranean mineral formation, according to embodiments of the present invention. The boiling fluid 20 enhances heat transfer from the outer surface of the casing 2 to the subterranean mineral formation 50 (e.g. the mineral formation and/or kerogen surrounding the well bore 10). According to some embodiments of the present invention, the boiling fluid 20 is shale oil. The boiling fluid 20 may, for example, be boiled at a temperature greater than 300° C. If there is no fluid 20 present in the bore 10, or in the locations in which fluid 20 is not present in the bore (e.g. above level 13), the heating system 1 heats the subterranean mineral formation 50 by thermal conduction through the casing 2 and into the subterranean mineral formation 50. In situations in which a fluid 20 is present in the bore 10, the heating system 1 heats the subterranean mineral formation 50 by convection. In situations in which the fluid 20 is boiling, the heating system 1 heats the subterranean mineral formation 50 by convection and refluxing, according to embodiments of the present invention. This convection occurs along the direction of arrows 16 as the heat rises, and at the liquid/gas interface 13, the shale oil vapors rise (indicated by arrow 17), while some of the shale oil vapors condense and reflux, according to embodiments of the present invention. According to some embodiments of the present invention, heat transfer between the casing 2 and the surrounding subterranean formation 50 may be optimized (e.g. to obtain higher heat transfer coefficients) by adjusting the height differences between levels 13 and 14.

Within the casing 2, the heating element 3 has a distal end 7 and a proximal end 6, with the distal end 7 positioned closer to distal end 8 of casing 2 and proximal end 6 positioned closer to proximal end 9, according to embodiments of the present invention. A surface connection system 5, which may also be referred to as an "umbilical," has a first end coupled to proximal end 6 of heating element 3, and a second end at a top ground surface above the subterranean mineral formation 50. The heating element 3 may be an electrical heating element, and the surface connection system 5 may provide electrical power from an above-ground source. The surface connection system 5 may also include wires or other control or sensing mechanisms attached to computers or other interface devices at the top surface, to permit the monitoring and/or control of the heating element 3 and the conditions within the heater system 1 and the well bore 10, according to embodiments of the present invention. The surface connection system 5 may also include one or more tubes or pipes to permit heat transfer fluid 140 to be added to, subtracted from, or sampled from the top ground surface, according to embodiments of the present invention. The surface connection system 5 may be flexible. According to some embodiments of the present invention, the surface connection system 5 may be used to withdraw and/or replace heat transfer fluid 140 and/or gases from the casing 2 to optimize performance. According to other embodiments of the present invention, heat transfer fluid 140 may be circulated from the surface, or with an internal or adjacent pump. According to some embodiments of the present invention, the level 13 of the heat transfer fluid 140 is higher, for example less than five percent higher, than the highest extent of the heating elements, for electrically heated elements.

The heating element 3 may include one or more electrical heaters or heater element assemblies, comprised of heating cables, tapes, and/or rods. For example, for example one or more mineral insulated (MI) cables or Calrod® type electrical heaters. The power supplied to the heating element 3 may be varied in order to adjust the heat transfer rate. If the heating elements are connected in a three-phase Wye configuration, it may be beneficial to have the number of elements be a multiple of three.

Embodiments of the present invention involve using an intermediate boiling heat transfer fluid ("HTF") between the heating element and the formation to be heated to regulate the temperature at which the heat is delivered. Examples of fluids and their working temperature ranges are shown in Table 1. The heat delivery temperature is determined by the balance of heat input and extraction from the HFT, and the pressure inside the heater varies with the temperature. The heating element can be an electrical heater, or a burner, or any other downhole heat generating or heat transfer device, for example a device that does not inherently include a mechanism for providing a uniform regulated temperature along the portion of the mineral formation to be heated. This may include, for example, a heat exchanger that has a non-uniform temperature along its length but, because of the intermediate heat transfer fluid, delivers a more uniform temperature to the boiling shale oil or oil shale formation.

TABLE 1

Examples of heat transfer fluids:

| | Fluid | | |
|---|---|---|---|
| | Steam (Sat.) | Therminol VP-1 ™ | Syltherm 800 ™ |
| Composition | water | diphenyl ether 73.5% biphenyl 26.5% | Dimethyl Polysiloxane |
| Max. Working Temperature - ° C. | 374 | 400 | 400 |
| Max. Film Temperature - ° C. | — | 427 | 427 |
| Freeze Point - ° C. | | 12 | <−40 |
| Vapor Pressure at Max. Working T - Mpa | 22.11 | 1.07 | 1.37 |
| Notes: | supercritical above | | 2-4 m/sec velocity rec. |

Within the casing 2, at least a portion of the heat transfer fluid 140 is undergoing phase changes between liquid and gas, in order to regulate a temperature of the casing 2. Once the heat transfer fluid 140 is subjected to a certain temperature and/or pressure which causes it to boil, the heat transfer fluid vapors rise above level 14 in the direction of arrow 18, after which the vapors condense and return to the liquid heat transfer fluid pool in the direction of arrow 19. As such, at least a portion of the heat transfer fluid 140 is undergoing a phase change between liquid and gas, which serves to regulate the temperature of the casing 2. In other words, fluctuations of power generated by the heating element 3 are absorbed by the heat transfer fluid 140, which uses the energy for the phase change process while maintaining the heat transfer fluid at a substantially constant temperature 140, thereby evenly heating the casing 2 and preventing overheating of the casing 2 and thus the liquid shale oil 20.

Embodiments of the present invention heat the shale oil 20 hot enough to deliver heat at a temperature adequate for retorting, in the desired time frame, but not so hot that the shale oil 20 is coked on the surface of the heater casing 2, or cracked to less valuable gas. The arrangement and use of heat transfer fluid 140 within the casing 2 allows the boiling of the shale oil 20 at a well-controlled and even temperature, according to embodiments of the present invention. FIG. 1 illustrates a heater system 1 in which a space between the heating element 3 and the casing 2 is unconstrained, to permit heat transfer from the heating element 3 to the casing 2 by free convection with the heat transfer fluid 140. According to embodiments of the present invention, the heat transfer fluid 140 is non-aqueous, and a rate of heat extraction from the heater element 3 meets or exceeds thirty Watts per square inch at temperatures greater than 350° C. According to embodiments of the present invention, the heat transfer fluid 140 is non-aqueous, and a rate of heat extraction from the heater element 3 exceeds twenty-six Watts per square inch at temperatures greater than 300° C.

Although FIG. 1 illustrates a longitudinal dimension of the heating system 1 extending at an angle with respect to the gravitational force 15, according to some embodiments of the present invention, the longitudinal dimension of the heating system 1 extends perpendicularly or substantially perpendicularly to the direction of the gravitational force 15 (e.g. in a "horizontal" direction), and according to other embodiments of the present invention, the longitudinal dimension of the heating system 1 extends parallel or substantially parallel to the direction of the gravitational force 15 (e.g. in a "vertical" direction). Numerous other orientations of the longitudinal dimension of the heating system 1 with respect to the gravitational force 15 may be employed.

Figure 2A:
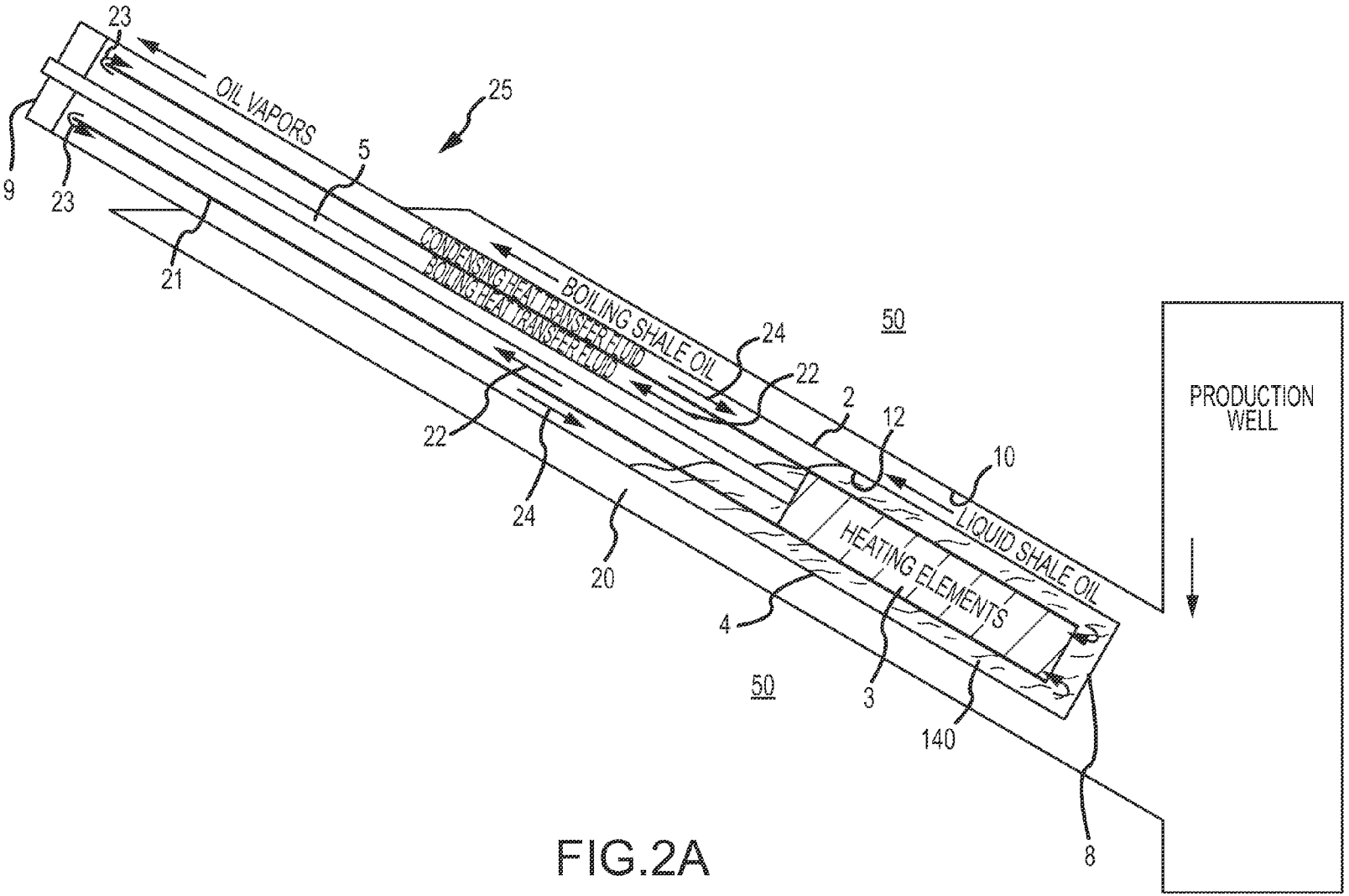
FIG. 2A illustrates a partial side sectional view of another heating system in a subterranean mineral formation, according to embodiments of the present invention.
Figure 2B:
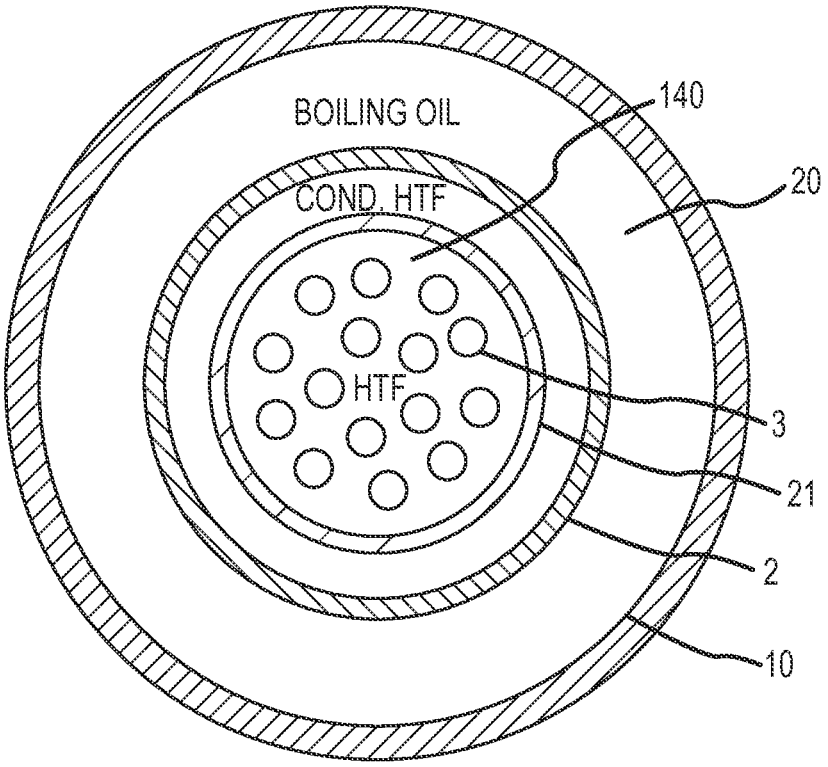
FIG. 2B illustrates a front cross sectional view of the heating system of FIG. 2A taken at a location of the heating element, according to embodiments of the present invention.

FIGS. 2A and 2B illustrate another heating system 25 in a subterranean mineral formation 50, according to embodiments of the present invention. System 25 is similar to system 1, except system 25 includes an optional guide tube 21 within the casing 2. The guide tube 21 guides convection of the heat transfer fluid 140 away from the heating element 3 on an inside of the guide tube 21, as indicated by arrows 22, and back toward the heating element 3 on an outside of the guide tube 21, as indicated by arrows 24, according to embodiments of the present invention. At the proximal end of the guide tube 21, the boiling heat transfer fluid 140 switches from inside the guide tube 21 to outside the guide tube 21 as it condenses, as indicated by arrows 23. Toward the distal end 8 of the casing 2, the heat transfer fluid 140 contacts the heating element 3, which may be a plurality of separate heating rods with spaces in between or which otherwise permit flow through heating elements in direction 22, and again travels through the inside of the guide tube 21. This arrangement in system 25 results in a channeled convection, which may be a variation of the free convection of system 1.

A wicking material (not shown), similar to that used in a conventional heat pipe, may be positioned between the outside of the guide tube 21 and the inner surface 12 of the casing to enhance flow of condensed heat transfer fluid 140 back toward the heating element 3, according to embodiments of the present invention. Such wicking material could forced condensed liquid heat transfer fluid 140 to flow towards the boiling pool around heating element 3. As illustrated in FIGS. 1 and 2, the relative longitudinal lengths of the heated section and the condensing section (the longitudinal length below level 14 (heated section) and above level 14 (condensing section)) may be varied. This can be accomplished by, for example, adding or withdrawing heat transfer fluid 140 from the casing 2. In system 1 of FIG. 1, most of the heat exchange occurs in the boiling heat transfer section below level 14. In system 1 of FIG. 1 and/or system 25 of FIG. 2, an optional circulation pump may be used to help circulate the heat transfer fluid 140 within the casing 2, according to embodiments of the present invention.

Figure 3:
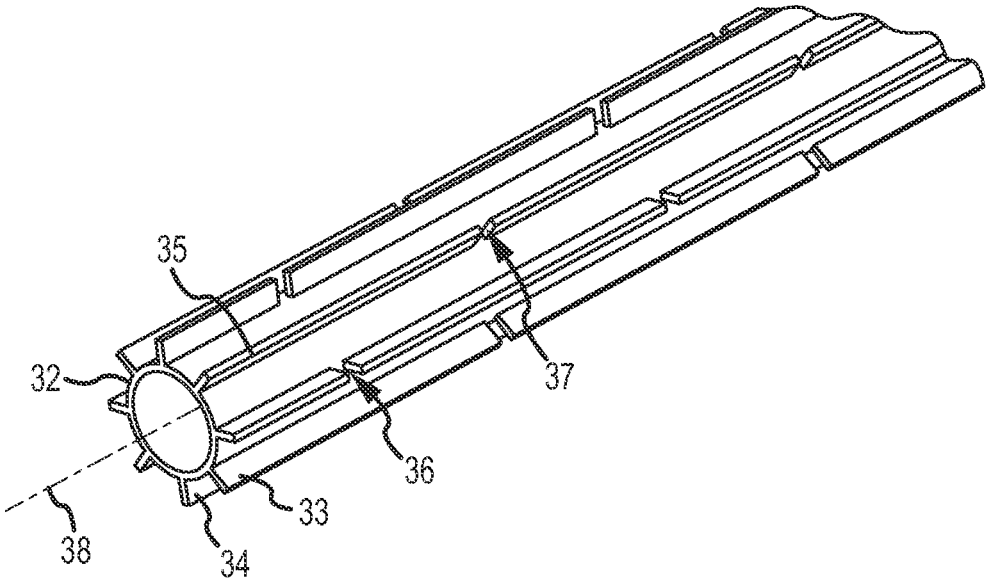
FIG. 3 illustrates a front and side perspective view of a heating system casing, according to embodiments of the present invention.

If the medium directly outside of the casing 2 is a fluid rather than a solid, fins may be placed on the outside of the heater casing 2 to facilitate heat transfer to the fluid, particularly if that fluid is used to distribute heat through the formation by convection. FIG. 3 illustrates a casing 32 whose outer surface includes a plurality of fins 33, 34, 35, which are configured to enhance a rate of heat transfer between the casing 32 and the subterranean mineral formation 50, according to embodiments of the present invention. The outer surface of the casing 32 is substantially cylindrical about a longitudinal axis 38, and each fin of the plurality of fins 33, 34, 35 extends along the outer surface substantially parallel to the longitudinal axis 38, according to embodiments of the present invention. The fins may include gaps 36, 37 formed at longitudinal intervals. As illustrated in FIG. 3, the longitudinal intervals between the gaps 36 for one fin are the same as, but longitudinally offset from, the longitudinal intervals between the gaps 37 for an adjacent fin. The fins 33, 34, 35 enhance a rate of heat transfer between the casing 32 and the subterranean mineral formation 50. According to one embodiment of the present invention, fins 33 may be one inch tall and ¼ inches wide, casing 32 may include eight to twelve rows of fins 33 evenly spaced (equal radial angles between each row), with twelve- to twenty-four-inch fin sections separated by ¾ inch gaps and/or with a gap offset of six inches between rows. The fins 33 may be welded on both edges to attach them to the casing 32, according to embodiments of the present invention.

Figure 4:
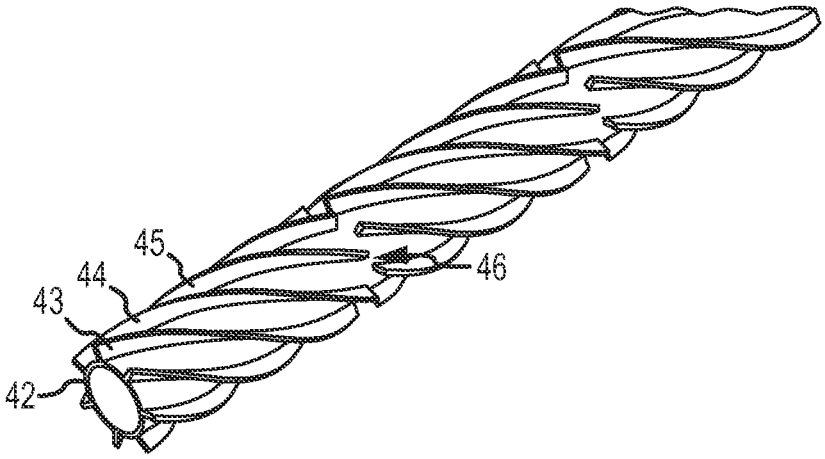
FIG. 4 illustrates a front and side perspective view of an alternative heating system casing, according to embodiments of the present invention.

FIG. 4 illustrates a casing 42 whose outer surface is substantially cylindrical, and from which protrude a plurality of fins 43, 44, 45 in a helical configuration. Each of the plurality of fins 43, 44, 45 may also include gaps 46 formed at longitudinal intervals, according to embodiments of the present invention. According to one embodiment of the present invention, the helical fins 43 are formed in segments which are twelve to twenty-four inches longitudinally, with the longitudinal segments being separated by a half inch to one inch gap.

According to some embodiments of the present invention, the fins of a casing 2 are vertical strips in casing orientations in which a longitudinal dimension of the casing 2 is vertical. According to other embodiments of the present invention, a fin configuration in which the fins are vertical disks (not shown) is used when the orientation of the casing 2 is horizontal or only slightly inclined. According to yet other embodiments of the present invention, if the casing 2 is positioned at an intermediate angle with respect to the horizontal and vertical positions, the fins 33 are strips with periodic gaps 36 as illustrated in FIG. 3, or helical ribbons 43 as illustrated in FIG. 4, to permit transverse and axial flow.

Figure 5:
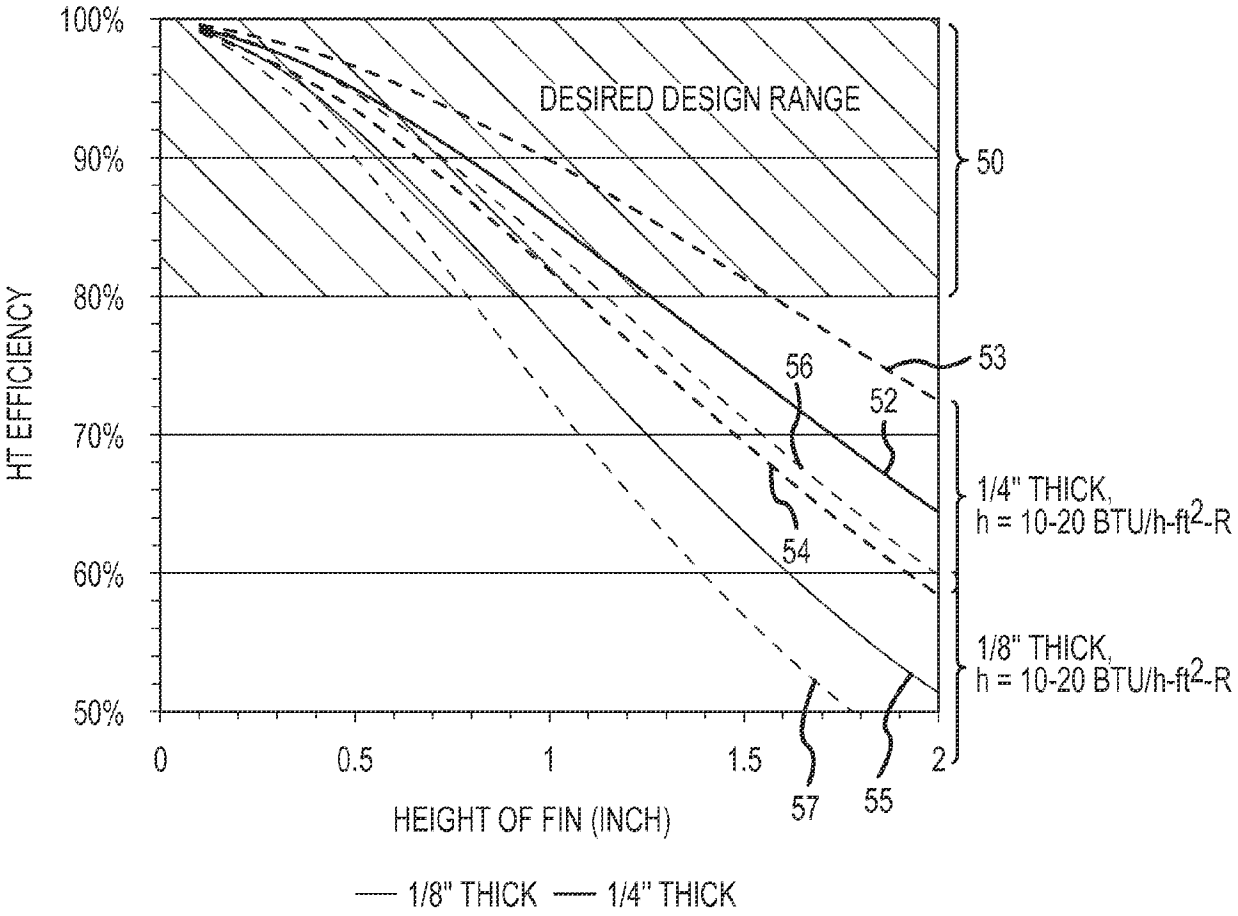
FIG. 5 illustrates a graph showing a relationship between heat transfer efficiency and height of fin for fins of two different thicknesses, according to embodiments of the present invention.

According to embodiments of the present invention, the height of each fin is between 0.5δ and 0.75δ, wherein δ is the gap height between the outer surface of the casing 2 and the inner surface 10 of the bore hole, when the heater system 1 is centered in the bore hole, according to embodiments of the present invention. The thickness of a fin may be selected by calculating the heat transfer efficiency for a fin and using an eighty to ninety percent efficiency point. FIG. 5 illustrates example calculations for heat transfer efficiency for a range of heat transfer coefficients and two fin thicknesses, as a function of fin height, according to embodiments of the present invention. The ¼" thick fin data is indicated by line 52, as well as upper boundary 53 and lower boundary 54, while the ⅛" thick fin data is indicated by line 55, as well as upper boundary 56 and lower boundary 57. The desired design range is indicated by bracket 50.

Figure 6:
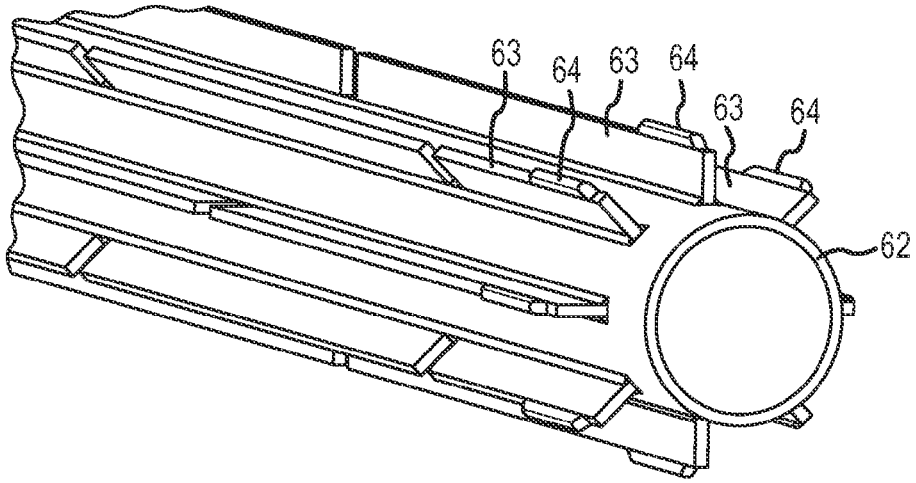
FIG. 6 illustrates a front and side perspective view of the heating system casing of FIG. 3 with spacers, according to embodiments of the present invention.
Figure 7:
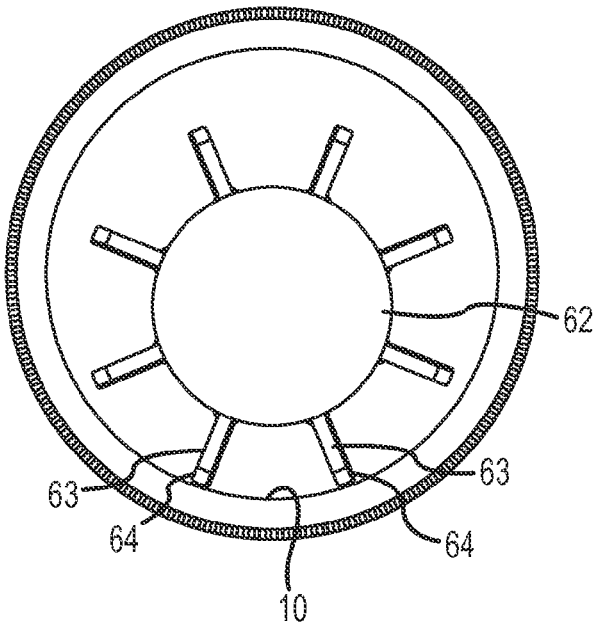
FIG. 7 illustrates a front elevation view of the heating system casing of FIG. 6 positioned within a well bore, according to embodiments of the present invention.
Figure 8:
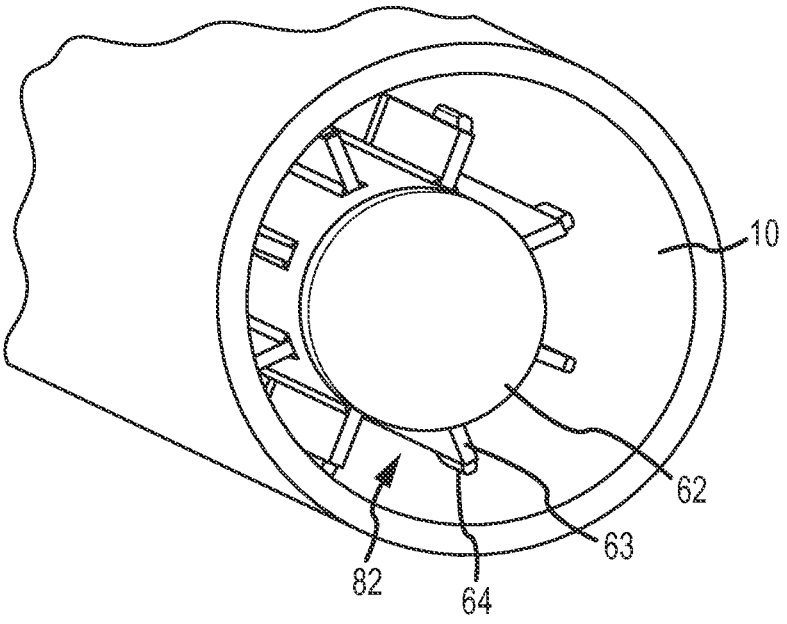
FIG. 8 illustrates a front and side perspective view of the heating system casing of FIG. 6 positioned within a well bore, according to embodiments of the present invention.

Because of the difficulty often encountered in perfectly centering a finned heater casing 62 in a bore hole 10 of interest, the height of fins or portions of fins may be increased in order to create a gap for fluid to flow around the bottom-most fins. This is illustrated in FIGS. 6, 7, and 8. Fins 63 each include a spacer 64 which permits fluid to flow under at least one of the plurality of fins 63 when the spacer 64 rests against the bore 10, according to embodiments of the present invention. Each fin 63 may include multiple spacers 64, separated by a distance which is relatively larger than the longitudinal interval length between the gaps 36, 37, according to embodiments of the present invention. For example, each of the spacers 64 may be two to eight inches long (longitudinally), and the first set of the spacers 64 may be placed on the fins 63 near the distal end of the fins 63 as illustrated in FIG. 6. The next set of spacers 64 may be placed on the fins ten to forty feet away (longitudinally), according to embodiments of the present invention. According to one embodiment of the present invention, the spacers 64 are ⅛ inches tall and positioned circumferentially around each fin 63. According to other embodiments, spacers 64 are placed on less than all fins 63, particularly for casings 62 which can be oriented such that the spacers 64 are oriented downwards to contact the bore hole 10. The spacers 64 may be made by a weld bead, machined metal sheet, and/or similar protrusion, and their longitudinal positioning may be selected to as to not permit the casing 62 to sag (thereby closing the gap between the fins 63 and the bore hole 10). FIGS. 7 and 8 illustrate deployment of casing 62 with eccentric positioning within a bore hole 10, and FIG. 8 illustrates a gap 82 on the bottom for fluid to flow under the fins 63, according to embodiments of the present invention.

Figure 9:
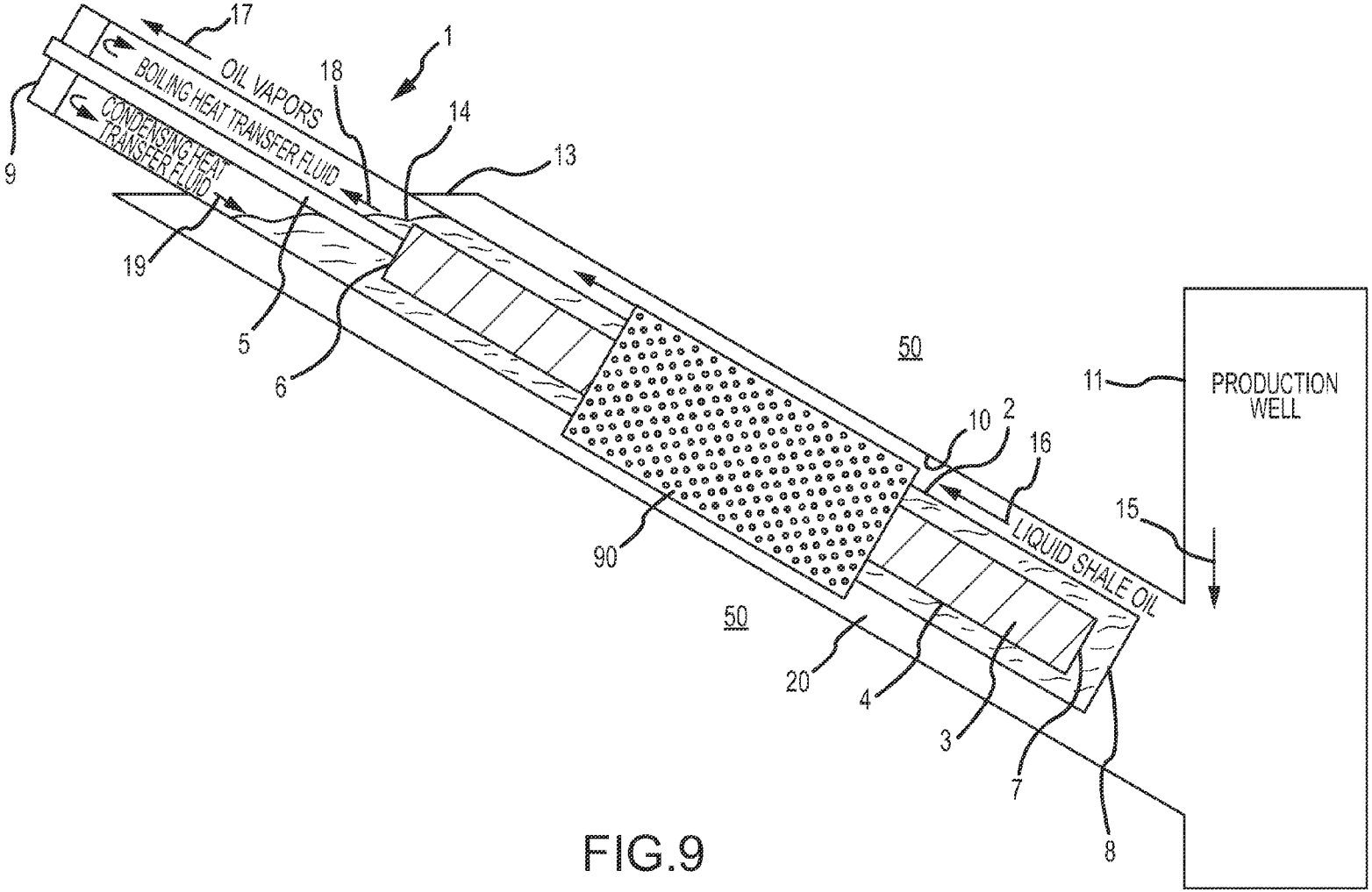
FIG. 9 illustrates a partial side sectional view of the heating system of FIG. 1 with a shroud applied around the heating system casing, according to embodiments of the present invention.

If the subterranean formation 50 is subject to rubblization, a shroud 90 may be positioned about the casing 2 between the casing 2 and the bore 10, as illustrated in FIG. 9. The shroud 90 may be configured to prevent rubble from settling directly against the casing 2, which may lower the heat transfer coefficient for the heating system 1, according to embodiments of the present invention. The shroud 90 may be a solid pipe or tube with open ends, and/or may have openings and/or perforations to enhance desired convection pathways, according to embodiments of the present invention. A rubble-filled annular space reduces the heat transfer coefficient by a factor of two to six compared to an unobstructed annular space, according to embodiments of the present invention.

According to some embodiments of the present invention, a control system may be used to prevent overheating and overpressuring of the heat transfer fluid 140. Such a control system may involve an ability to measure temperature at one or more locations within the heater system 1, for example one or more thermocouples and/or a high temperature fiber optic sensor, and/or a pressure gauge.

Figure 10A:
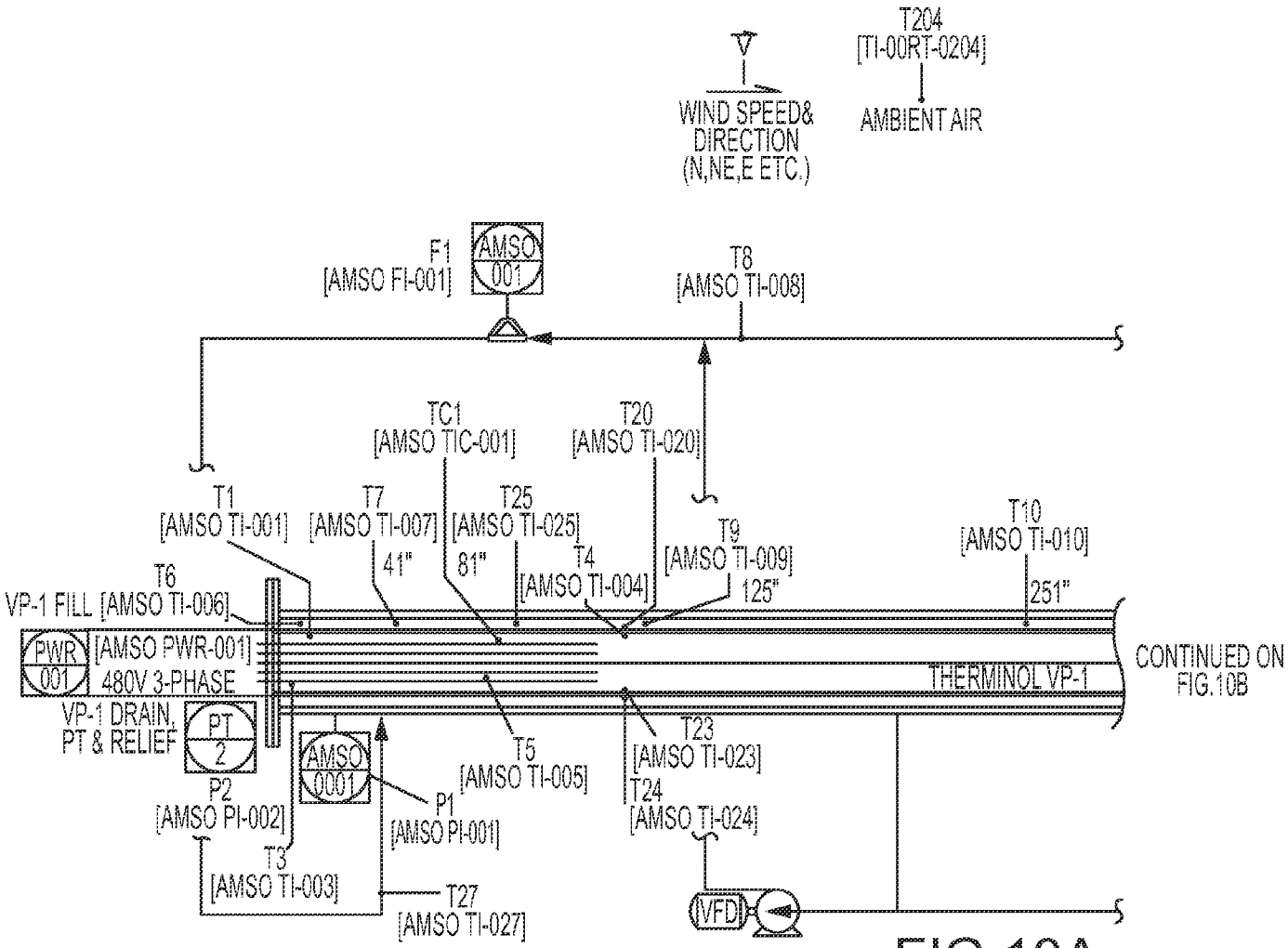
FIG. 10 illustrates a diagram of a heater test stand control system, according to embodiments of the present invention.
Figure 10B:
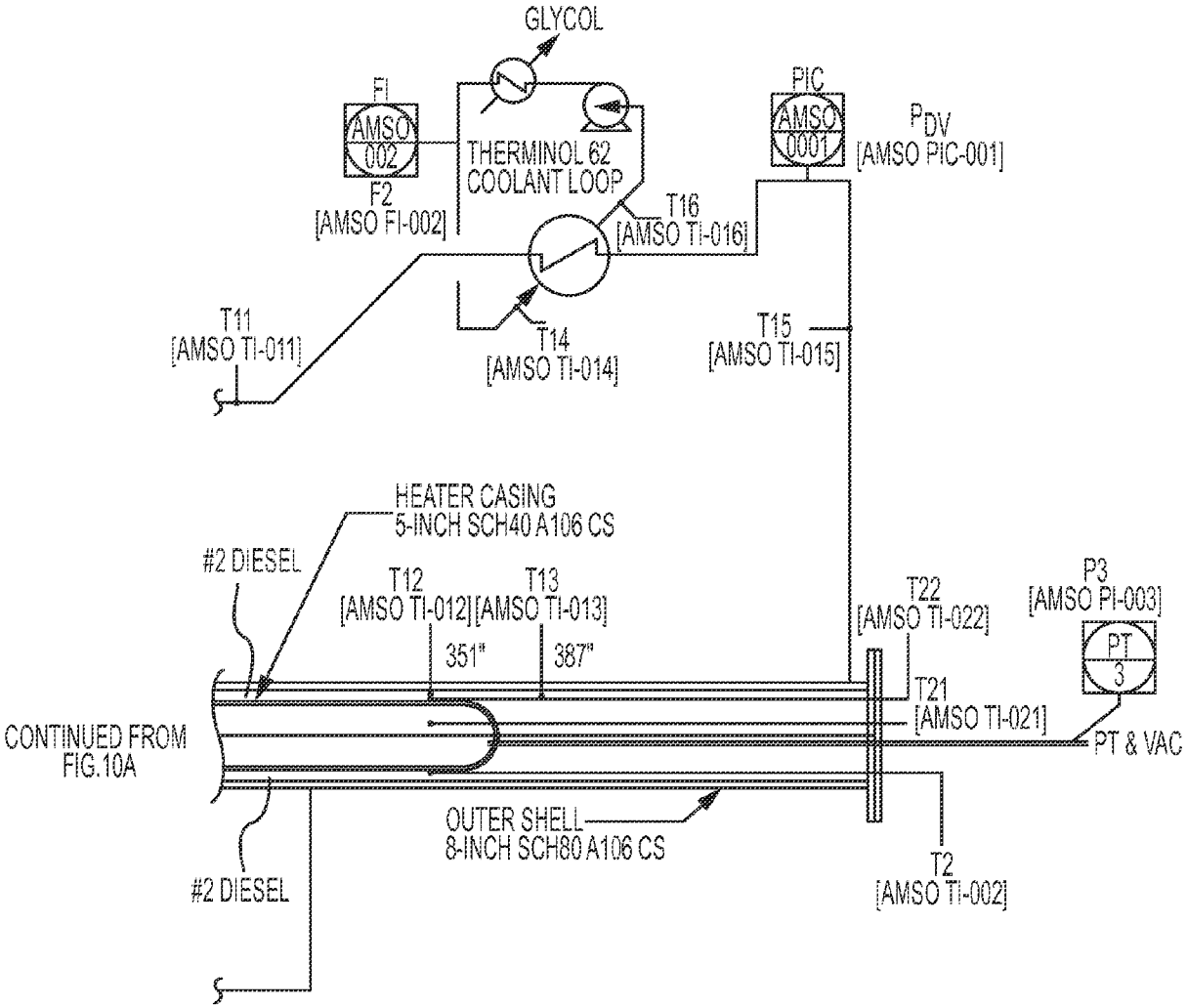

The heat flux deliverable by the heater system 1 may depend on the ability of the surrounding material (e.g. formation 50) to dissipate heat at the operational temperature. When immersed in a liquid 20, higher heat transfer coefficients may be obtained. A test stand was constructed to measure such heat transfer coefficients. A specific heater configuration using six ¾ inch heating rods (as heating element 3) in a four-inch diameter tube (as casing 2) was tested in an eight-inch diameter by forty-foot long simulated well bore, as illustrated in FIG. 10. Heat transfer coefficients up to 26 $W/m^2$-K have been obtained when using Therminol® VP-1 as the heat transfer fluid 140 and immersing the heater in fuel oil boiling at 300° C. Dowtherm A™ may also be used as a heat transfer fluid.

FIG. 10 also illustrates a variable frequency drive pump VFD which may be used in a closed loop system to circulate the simulated fluid to be extracted (e.g. diesel fuel used to simulate shale oil), and may also include a coolant loop as shown to help condense any boiling simulated extraction fluid prior to its return to the system.

Figure 11A:
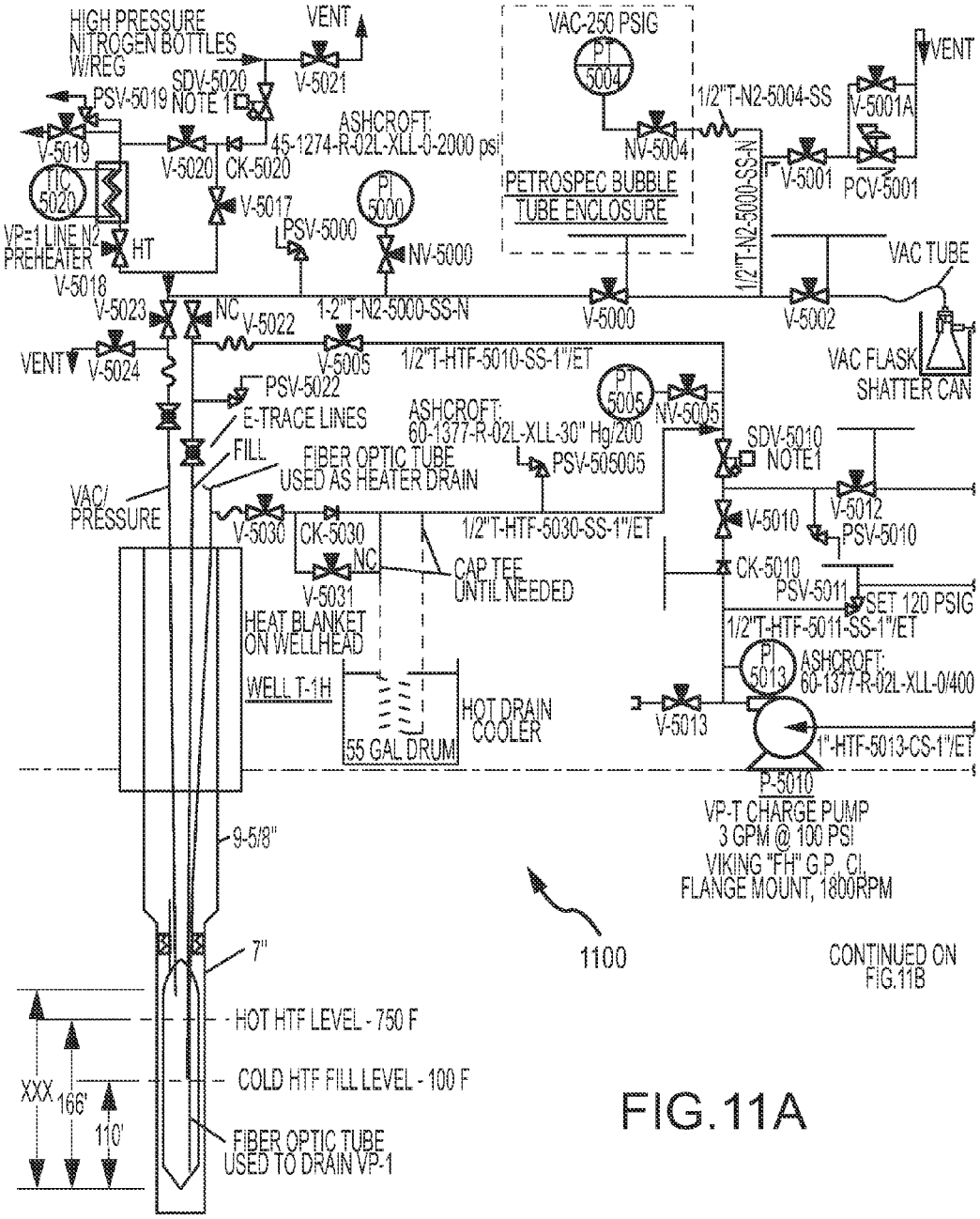
FIG. 11 illustrates a diagram of a heat transfer fluid fill and level control system, according to embodiments of the present invention.
Figure 11B:
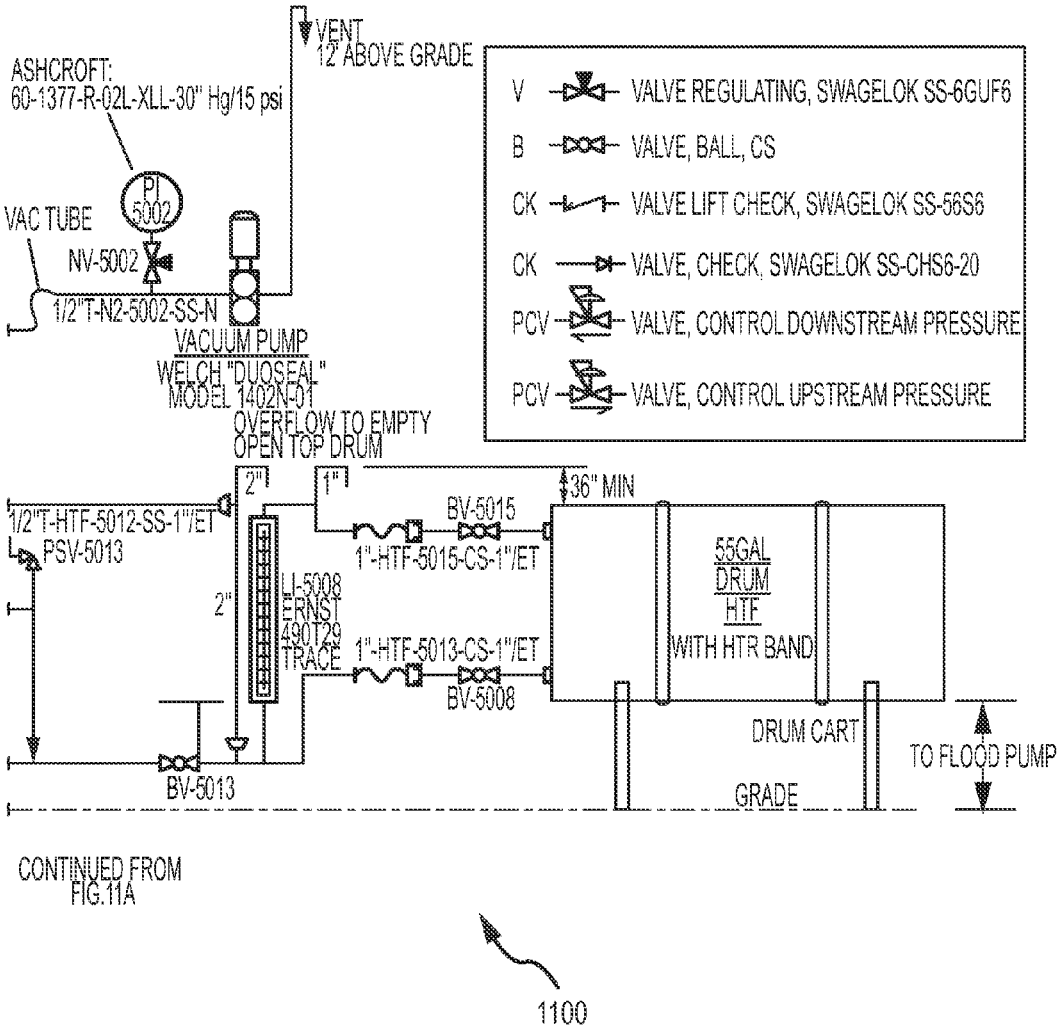

FIG. 11 illustrates a diagram of a heat transfer fluid fill and level control system 1100, according to embodiments of the present invention. System 1100 may be used to fill the casing 2 with heat transfer fluid 140, and includes a fill tube and a "spill" tube. The fill tube sends the heat transfer fluid into the heating system (e.g. heating system 1 or 25), and the "spill tube" may be used to evaluate the head space and any overfill of heat transfer fluid. A drain tube, which may be attached at the bottom of the heating system, may be used to empty the heat transfer fluid by filling the heater with gas and pushing the heat transfer fluid out, according to embodiments of the present invention.

Figure 12:
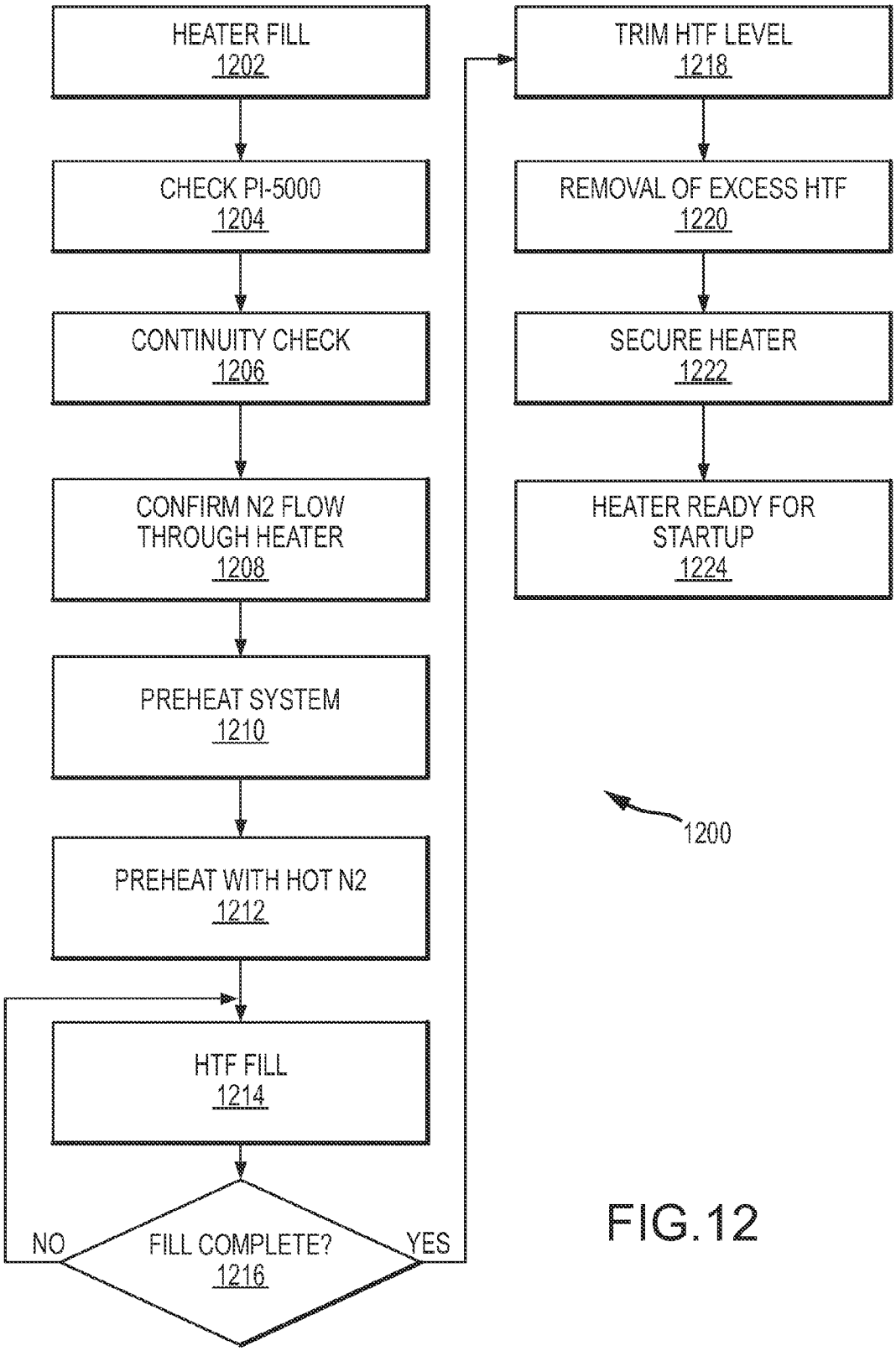
FIG. 12 depicts a flow chart illustrating a heat transfer fluid fill and leveling method, according to embodiments of the present invention.

FIG. 12 depicts a flow chart 1200 illustrating a heat transfer fluid fill and leveling method, using the system 1100 of FIG. 11, according to embodiments of the present invention. At block 1202, the heater may be filled, for example using the following steps:

HEATER STATUS CHECK
- CLOSE V-5000, V-5010, & V-5012
- OPEN NV-5000 TO PI-5000
- CRACK OPEN THE WELLHEAD VAC/P VALVE

At block 1204, the pressure indicator may be checked, for example using the following steps:

IF PRESSURED, VENT THRU V-5000, V-5001 & V-5001A
CLOSE V-5000 AND OBSERVE PI-5000
IF THERE IS A PRESSURE RISE IN 1 HOUR THERE IS A HEATER CASING LEAK. STOP!
IF NO PRESSURE RISE—PROCEED

At block 1206, a continuity check may be performed, for example using the following steps:

OPEN V-5000 AND CLOSE V-5001 & V-5001A
OPEN N2 SUPPLY TO V-5020 AT 50 PSI N2 BOTTLE REGULATOR PRESSURE
CLOSE V-5012 & OPEN NV-5004 TO PI-5004
CRACK OPEN V-5020 TO ALLOW N2 FLOW.

At block 1208, the flow of nitrogen gas through the heater may be confirmed, for example using the following steps:

WATCH PI-5004
INCREASE N2 FLOW THROUGH V-5020 UNTIL PI-5004 SHOWS 10 PSI OR VALVE IS FULL OPEN
CHECK FOR N2 FLOW AT DRUM VENT AND CONNECTIONS WHEN FLOW IS ESTABLISHED, SHUT OFF N2 SUPPLY
PI-5004 PRESSURE SHOULD DROP TO 0 PSIG.
IF SO, CHECK IS COMPLETE. SHUT OFF N2 SUPPLY.
CLOSE V-5020, V-5012 & NV-5004
EVACUATE HEATER CASING AND BREAK WITH N2.

At block 1210, the system may be preheated, for example using the following steps:

ATTACH DRUM OF WARMED VP-1 TO THE FILL MANIFOLD. MAINTAIN AT ~100 F.
PREHEAT VP-1 LINES 5010, 5011, 5012, 5013 AND 5015 TO ~100 F WITH TRACING.
PREHEAT WELLHEAD WITH HEATER BLANKET.
USE 200 F N2 TO PREHEAT ⅜" VP-1 FILL LINE WITHIN WELL.

At block 1212, a preheat may be conducted with hot nitrogen, for example using the following steps:

CLOSE NV-5000. SET N2 SUPPLY REGULATOR TO 100 PSIG.
OPEN THE VAC/P & FILL VALVES ON THE WELLHEAD.
START N2 FLOW TO LINE 5000. CONFIRM FLOW.
SET TIC-5020 TO 250 F.
OBSERVE DOWNHOLE HEATER TEMPERATURES (TI—XXX. TI—XXX)
WHEN ALL LINES ARE WARM—START VP-1 (HTF) FILL.

At block 1214, the heat transfer fluid fill process may be conducted, for example using the following steps:

ASSURE THAT V-5013 IS OPEN
OPEN BV-5008, BV-5015, & BV-5013. OBSERV LEVEL IN SIGHT
GLASS, LI-5008.
OPEN V-5012 AND OPEN V-5010 1 TURN.
START P-5010, PI-5013 SHOULD INDICATE<30 PSI
OPEN V-5010
WHEN PI-5008 IS AT "EMPTY" READING:
- SHUT OFF P-5013
- CLOSE BV-5013, BV-5008 AND BV-5015

REMOVE "EMPTY" DRUM
- CATCH ANY HTF LEAKAGE AND RETURN TO EMPTY DRUM.

IT MAY BE POSSIBLE TO SEE THE LEVEL ON THE FIBER OPTIC SENSOR.

At block 1216, a determination is made about whether the fill is complete (e.g. has enough heat transfer fluid been provided to the heater system). If yes, then the process moves to block 1218. If not, then the process repeats block 1214 as shown.

At block 1218, the level of the heat transfer fluid may be trimmed, for example using the following steps:

CLOSE BV-5013, V-5010, V-5000 & NV-5004
OPEN V-5012
USING THE HIGH PRESSURE N2 SUPPLY THROUGH V-5020, WITH THE SUPPLY REGULATOR SET AT 100 PSIG, SLOWY OPEN V-5020

At block 1220, excess heat transfer fluid may be removed, for example using the following steps:

AS V-5020 IS CRACKED, OBSERVE THE PRESSURE ON PI-5000 IF IT STOPS RISING, THE HTF FILL MAY NOT BE COVERING THE FILL TUBE OPENING IN THE HEATER CASING—CHECK—IF N2 IS VENTING FROM THE DRUM VENT, RETURN TO BLOCK 1214.
WHEN THE PRESSURE STABLIZES AT 100 PSIG, BEGIN RAISING REGULATOR PRESSURE IN 50 PSIG INCREMENTS.
WATCH LI-5008 FOR AN INDICATED INCREASE IN HTF DRUM LEVEL
WHEN A HTF LEVEL RISE IS FIRST NOTED, CLOSE V-5020.
NOTE THE PRESSURE ON PI-5000. SET THE HIGH PRESSURE N2 REGULATOR TO THIS PRESSURE AND CRACK OPEN V-5020
ADJUST THE N2 REGULATOR TO GIVE A GRADUAL LEVEL INCREASE IN THE VP-1 SUPPLY DRUM LEVEL (LI-5013).
EXPECT THAT ABOUT 940 PSIG WILL BE REQUIRED TO REMOVE EXCESS VP-1 FROM THE HEATER.
DO NOT ALLOW THE DRUM TO OVERFLOW!
AS SOON AS N2 STARTS VENTING FROM THE VP-1 DRUM WENT LINE, OR IF THE PRESSURE ON PI-5000 STARTS TO DROP, CLOSE VALVE V-5020.
THE HTF IN THE HEATER IS NOW AT THE DESIRED LEVEL.

At block 1222, the heater may be secured, for example using the following steps:

CLOSE VALVE V-5012

ASSURE V-5001 & V-5001A ARE FULL Y OPEN

VERY SLOWLY, CRACK OPEN V-5000

WATCH PI-5000—ADJUST V-5000 TO DROP PRESSURE AT 10 PSI/MIN OR LESS

IF FOAM IS OBSERVED AT THE VENT, CLOSE V-5000 AND RETRY AFTER 10 MINUTES.

WHEN THE HEATER IS AT ATMOSPHERIC PRESSURE CLOSE THE BLOCK VALVES ON THE FILL AND VAC/PRESSURE VALVES AT THE WELLHEAD

OPEN V-5000 FULLY.

At block 1224, the heater is ready for startup, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A heating system for a subterranean mineral formation, the heating system comprising:

a casing positioned in a bore in the subterranean mineral formation, the casing having a longitudinal axis, an outer surface and an inner surface;

a heating element positioned within the casing;

wherein the casing is at least partially immersed in a boiling fluid in the bore of the subterranean mineral formation, wherein the boiling fluid enhances heat transfer from the outer surface of the casing to the subterranean mineral formation; and a plurality of fins on the outer surface of the casing extending in a direction substantially parallel to the longitudinal axis, wherein each of the plurality of fins includes unobstructed gaps formed at longitudinal intervals;

wherein a length of the longitudinal intervals for a first fin of the plurality of fins are substantially the same as, but offset longitudinally from, the length of the longitudinal intervals of a radially adjacent second fin of the plurality of fins.

2. The heating system of claim 1, wherein at least one of the plurality of fins comprises a spacer, such that a fluid is permitted to flow under the at least one of the plurality of fins when the spacer rests against the bore.

3. The heating system of claim 2, wherein the spacer is a first spacer, and wherein the at least one of the plurality of fins comprises a second spacer, and wherein a distance between the first spacer and the second spacer is longer than each of the longitudinal intervals.

4. A heating system for a subterranean mineral formation, the heating system comprising:

a casing positioned in a bore in the subterranean mineral formation, the casing having a longitudinal axis, an outer surface and an inner surface;

a heating element positioned within the casing;

wherein the casing is at least partially immersed in a boiling fluid in the bore of the subterranean mineral formation, wherein the boiling fluid enhances heat transfer from the outer surface of the casing to the subterranean mineral formation; and a plurality of fins on the outer surface of the casing extending in a direction substantially parallel to the longitudinal axis, wherein each of the plurality of fins includes unobstructed gaps formed at longitudinal intervals;

wherein at least one of the plurality of fins comprises a spacer, such that a fluid is permitted to flow under the at least one of the plurality of fins when the spacer rests against the bore.

5. The heating system of claim 4, wherein the spacer is a first spacer, and wherein the at least one of the plurality of fins comprises a second spacer, and wherein a distance between the first spacer and the second spacer is longer than each of the longitudinal intervals.

* * * * *